US009764891B1

(12) United States Patent
Aviles et al.

(10) Patent No.: US 9,764,891 B1
(45) Date of Patent: Sep. 19, 2017

(54) MULTI-CHAMBER BEVERAGE CARTRIDGE

(71) Applicant: FusionLink, LLC, New York, NY (US)

(72) Inventors: Victor M. Aviles, East Sandwich, MA (US); Carlos Alvarez, Old Bridge, NJ (US); Terrance Kaiserman, Loxahatchee, FL (US); Andrew Ferber, New York, NY (US); Julia Truchsess, Sandy Hook, CT (US)

(73) Assignee: FusionLink, LLC, New York, NY (US)

( * ) Notice: Subject to any disclaimer, the term of this patent is extended or adjusted under 35 U.S.C. 154(b) by 0 days.

(21) Appl. No.: 15/257,536

(22) Filed: Sep. 6, 2016

(51) Int. Cl.
*B65D 85/804* (2006.01)

(52) U.S. Cl.
CPC ..... *B65D 85/8043* (2013.01)

(58) Field of Classification Search
CPC ..... B65D 85/8043
See application file for complete search history.

(56) References Cited

U.S. PATENT DOCUMENTS

2004/0115317 A1* 6/2004 Doglioni ..... A47J 31/0673 426/123
2009/0110775 A1* 4/2009 Rijskamp ..... A47J 31/3628 426/77
2010/0180774 A1* 7/2010 Kollep ..... B65D 85/8043 99/295
2012/0058226 A1* 3/2012 Winkler ..... A47J 31/3695 426/79
2012/0258219 A1* 10/2012 Wong ..... A47J 31/3695 426/394
2013/0078340 A1* 3/2013 Glucksman ..... B65D 85/8043 426/112
2013/0139699 A1* 6/2013 Rivera ..... B65D 85/8043 99/295

FOREIGN PATENT DOCUMENTS

WO WO 2008/125256 * 10/2008 ..... B65D 85/804

* cited by examiner

*Primary Examiner* — Erik Kashnikow
*Assistant Examiner* — Chaim Smith
(74) *Attorney, Agent, or Firm* — Lerner, David, Littenberg, Krumholz & Mentlik, LLP

(57) ABSTRACT

The disclosure relates to a multi-chamber cartridge. The multi-chamber cartridge may include two chambers separated by a membrane. The two chambers may include a first chamber storing a first substance is positioned adjacent a second chamber. The multi-chamber cartridge may further include a piercing mechanism mounted within the first chamber. Upon an external force being applied to the piercing mechanism, the piercing mechanism pierces the membrane to allow the first substance to move to the second chamber.

19 Claims, 11 Drawing Sheets

MULTI-CHAMBER BEVERAGE CARTRIDGE

BACKGROUND

Cartridges for use with beverage making machines are well known, and can include one or more filters as well as a beverage medium, such as ground coffee beans, tea leaves, etc. In some cartridges, the filter is located between two or more portions of an interior space (e.g., one portion in which a beverage medium is located and a second portion into which liquid that has passed through the permeable filter can flow). Examples of such cartridges are disclosed in U.S. Pat. Nos. 5,840,189 and 6,607,762. Those cartridges can be used with a beverage making machine like that described in U.S. Pat. No. 7,398,726. The disclosures of U.S. Pat. Nos. 5,840,189; 6,607,762; and 7,398,726 are hereby incorporated by reference in their respective entireties. In use, the beverage making machine introduces a pressurized fluid into a cartridge to interact with a beverage medium. In some machines, a piercing outlet needle of the machine is used to pierce a surface of the cartridge (e.g., a bottom wall of the cartridge container or the cartridge lid) permitting the pressurized liquid that has interacted with the beverage medium to flow through the filter and exit the cartridge.

Some cartridges are configured to contain one or more dry beverage mediums. These cartridges incorporate a permeable filter and as such are incapable of containing ingredients that are suitable to create a beverage that requires both a dry beverage medium and a liquid beverage medium.

Other cartridges are limited in that they are configured to contain two or more dry and/or liquid beverage mediums by incorporating a barrier, such as a fluid permeable valve or a frangible joint, between portions of the cartridge. Because the valve is fluid permeable, only dry beverage mediums may be stored within portions of the cartridge containing the valve, as fluids would permeate the valve and quickly spoil a beverage medium of an adjacent portion of the pod. While frangible joints may permit fluids to be stored in separate, adjacent portions of the cartridge, the frangible joints are fragile and easily broken.

Accordingly it is desirable to provide a cartridge that contains dry and/or fluid substances in separate chambers and selectively mixes the substances when ready for use.

BRIEF SUMMARY

Embodiments within the disclosure relate generally to a multi-chamber cartridge. The multi-chamber cartridge may include a plurality of chambers, a membrane, and a piercing mechanism. The membrane may be arranged to separate a first and second one of the chambers and the first chamber may store a first substance and be positioned adjacent to the second chamber. The piercing mechanism may be mounted within the first chamber and upon an external force being applied to the piercing mechanism, the piercing mechanism may pierce the membrane to allow the first substance to flow into the second chamber.

In some embodiments the multi-chamber cartridge may include a filter positioned within the first chamber.

In some embodiments the second chamber may store a second substance.

In some embodiments the multi-chamber cartridge may further include a container. The container may have a sidewall, a base, and an interior space, wherein the sidewall may have a rim which projects outwardly from the sidewall, defining an opening of the container. The sidewall may have one or more inwardly extending projections. A seal may be attached to the rim and is arranged to close the opening of the container.

In some embodiments the membrane may be attached to a module. The module may include a top and one or more side walls and the module may be positioned on one or more of the projections. The first chamber may be a first portion of the interior space of the container enclosed within the module. The second chamber may be a second portion of the interior space of the container enclosed between the membrane and the base of the container.

In some embodiments the container may be comprised of one or more of a polymer laminate, polymer, biopolymer, compostable polymer, metal, ceramic, nylon, polypropylene, paper, and foil.

In some embodiments the multi-chamber cartridge may further include a third chamber and a second membrane arranged between the second and third chambers, wherein the third chamber stores a third substance.

In some embodiments the piercing mechanism may include a shaft and a piercing tip. The piercing mechanism may be comprised of one or more of a polymer laminate, polymer, biopolymer, compostable polymer, metal, ceramic, nylon, polypropylene, paper, and foil. The piercing mechanism may be bi-stable having an engaged and disengaged state.

The piercing mechanism may further include a cuff and one or more arms and the shaft may be attached to the cuff by the one or more arms, and the piercing top may be attached to the shaft.

In some embodiments the cartridge may include inwardly extending projections, and the cuff may be mounted on at least one of the projections.

In some embodiments the multi-chamber cartridge of may include a second piercing mechanism mounted within the second chamber, wherein upon the piercing mechanism piercing the membrane, the piercing mechanism provides a second force upon the second piercing mechanism and upon the second force being applied to the second piercing mechanism the second piercing mechanism pierces the second membrane to allow the first and second substance to move to the third chamber and mix with the third substance.

DETAILED DESCRIPTION

The illustrative embodiments described herein are exemplary and are not intended to show all embodiments of the invention. It should be understood that aspects of the invention can be used alone or in any suitable combination with other aspects of the invention. In this regard, aspects of each embodiment may be used in all other embodiments.

One embodiment of the present invention relates to a multi-chamber cartridge including two or more chambers, such that materials within the chambers remain separated by a membrane until an internal piercing mechanism breaks the membrane. In this regard, the multi-chamber cartridge may include a membrane between at least two chambers of a beverage cartridge so that the material in the respective chambers is maintained separate and fresh.

The cartridge of the present invention may include one or more piercing mechanisms that can be activated from a disengaged position to a piercing position upon insertion of the cartridge into a dispensing machine and applying an external force to the cartridge. Upon being activated into the piercing position, the piercing mechanism may puncture the membrane, thereby allowing the materials within the respective chambers to mix together.

Figure 1:
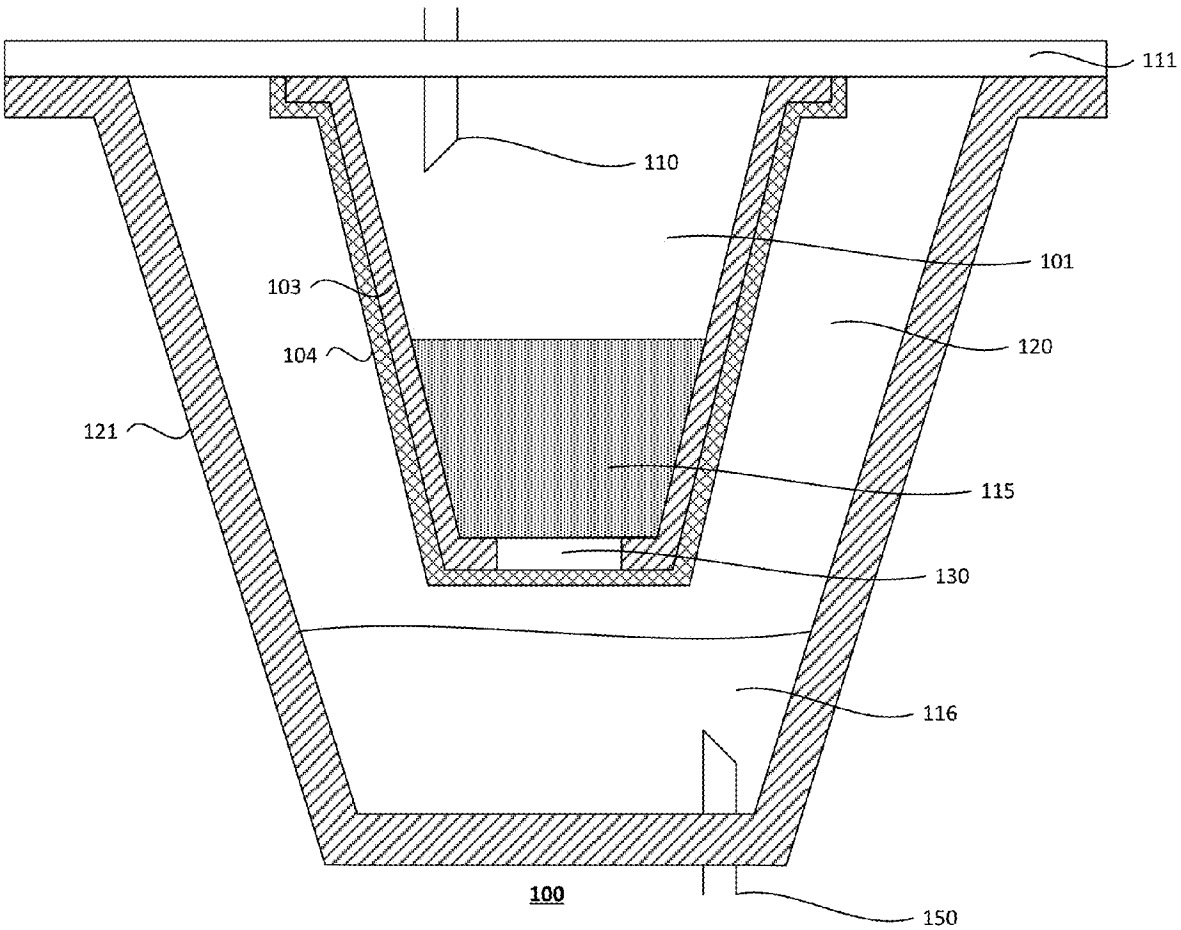
PRIOR ART FIGURE 1
FIG. 1 is an illustration of a prior art multi-chamber cartridge.

As previously discussed, known cartridges are limited in that they are configured to contain one or more dry beverage mediums and one or more liquid beverage mediums by incorporating a barrier, such as a fluid permeable valve or a frangible joint, between chambers of the cartridge. FIG. 1 illustrates one such cartridge 100, which was previously disclosed in U.S. Pat. No. 9,227,778, which is hereby incorporated by reference in its entirety. The cartridge 100 may be used in a beverage forming machine which introduces a pressurized liquid into a first chamber 101 of the cartridge via an externally located injection needle 110 which penetrates a lid 111. The first chamber 101 may contain a dry substance, such as coffee grounds 115.

A valve allows the pressurized liquid to pass through the first chamber 101 to a second chamber 120 of the cartridge. For instance, upon the pressurized liquid passing through the coffee grounds, the liquid penetrates the fluid permeable valve 130 positioned in the walls 103 of the first chamber, and passes through a filter 104 into the second chamber 120. The filter 104 is intended to prevent the coffee grounds 115 from passing into the second chamber 120.

The liquid mixes with a second substance in the second chamber 120. For instance, the pressurized liquid may mix with another second fluid 116 in the second chamber 120. The second fluid 116 may be an alcohol or other fluid. The wall 121 of the second chamber may be pierced by a second externally located needle 150 to release the mixed fluid.

Since the valve 130 is fluid permeable, the first chamber 101 may only contain dry substances prior to use, otherwise the substances in the first chamber 101 would prematurely penetrate the valve 130 into the second chamber 120. Additionally, the penetration of an externally located needle into the cartridge 100 may carry contaminants which could spoil the substances within the cartridge and contaminate a potentially sterile environment within the cartridge 100. The present invention includes improvements and cures the deficiencies of known cartridges, such as cartridge 100.

Figure 2:
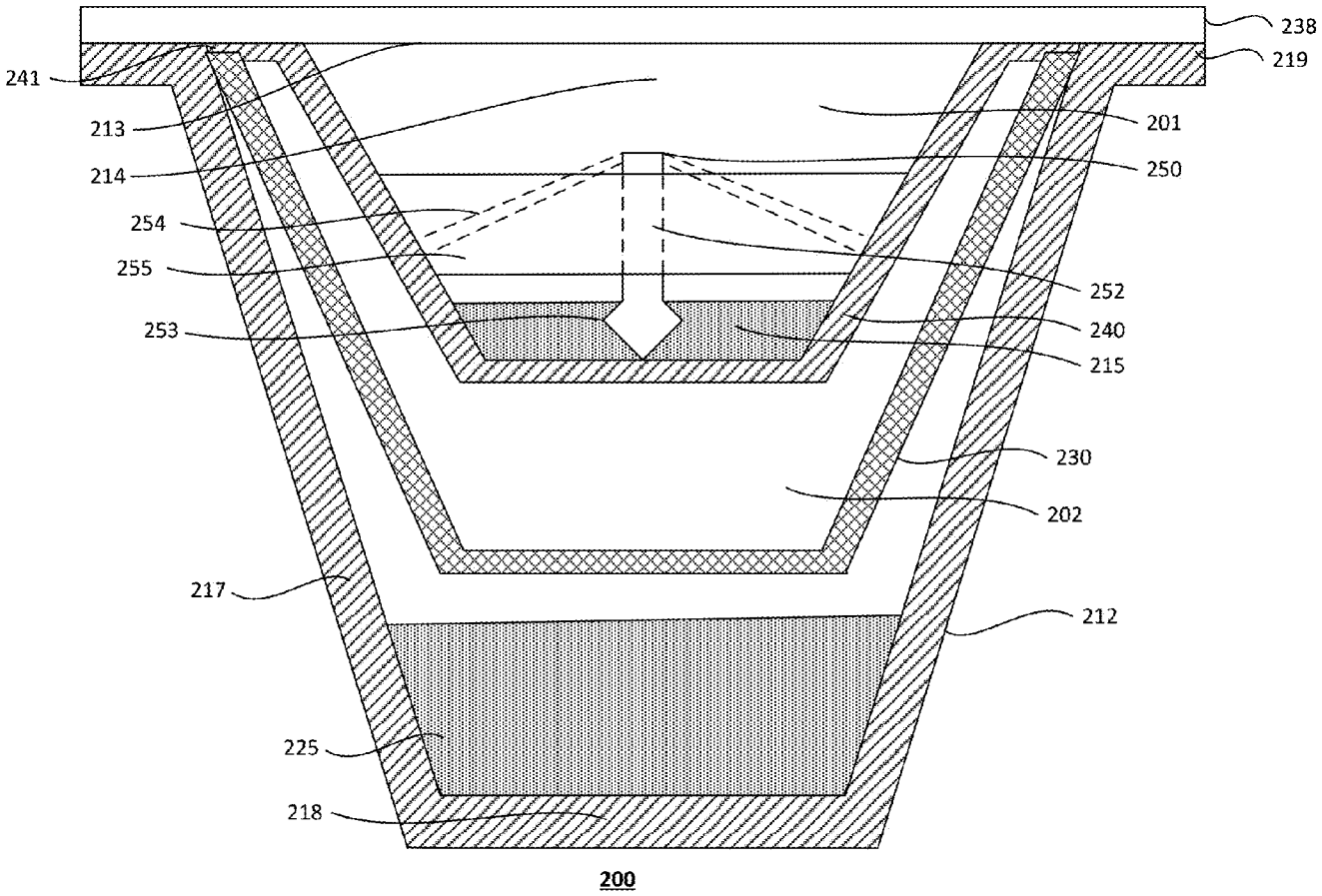
FIG. 2 is an illustration of a multi-chamber cartridge in accordance with one aspect of the present invention.

FIG. 2 is a side cross-sectional view of a cartridge 200 that incorporates one or more aspects of the invention. The cartridge 200 include a container 212 with one or more interior spaces including a first chamber 201 and a second chamber 202 that are separated by a membrane 240. The first chamber is arranged adjacent to the second chamber. As used herein, one chamber being "adjacent" to another chamber means that such chamber is next to or within the other chamber.

The membrane 240 may be configured to selectively isolate the first chamber 201 and second chamber 202 such that the material in the respective chambers are maintained separate and fresh. The membrane 240 may be constructed from one or more fluid non-permeable materials including polypropylene and cellulose material, a polymer laminate, e.g., formed from a sheet including a layer of aluminum, polystyrene and polypropylene and a layer of Ethylene Vinyl Alcohol copolymer "EVOH" and other such barrier materials. The membrane 240 may be flexible or rigid, and may also be constructed from paper, bamboo, recycled materials, and other such films.

Each chamber may contain one or more dry and/or fluid substances (e.g., liquids and gases). In this regard, the cartridge may be used in the preparation of a near limitless number of items and each chamber within the cartridge may store fluid and/or dry substances. For example, the cartridge may be used to create beverages such as tea, coffee, or other infusion-type beverages formed from dry and/or liquid beverage substances. Thus, the first chamber 201 may contain any suitable first substance 215, such as a fluid (e.g., an alcoholic ingredient, dairy product, liquid flavoring and the like,) and the second chamber 202 may contain a second beverage substance 225, such as a dry ingredient (e.g., ground coffee, tea leaves, dry herbal tea, powdered beverage concentrate, powdered milk, dry creamers, sweeteners, thickeners, flavorings, and/or other such dry beverage-making material).

The cartridge may prepare and release substances other than beverages. In this regard, the cartridges may be used in the preparation or dispensing of medicines, foods, etc. For example, the cartridge may store food ingredients, such as a liquid soup concentrate in the first chamber 201 and dehydrated or fresh vegetables, pasta, rice, etc., for the soup in the second chamber 202. Upon activation of the piercing mechanism 250, the liquid soup concentrate would release into the second chamber to mix with the other ingredients in the second chamber 202. The external injection needle may penetrate the lid 238, or any other portion of the cartridge 200, and introduce hot water to dilute the liquid soup concentrate and heat the ingredients. The completed soup may be emptied from the cartridge such as by removing the lid 238. In another embodiment, the cartridge may dispense and track medicine that is poured into chambered reservoir by a customer, pharmacy or pharmaceutical company.

In the embodiment of FIG. 2, the membrane 240 may have a substantially frustoconical shape. However, the membrane 240 may have any suitable shape, such as a cylindrical shape, spherical shape, semi-spherical shape, a square cup shape, a domed shape, a flat shape, or other. Further, the membrane 240 may have the same or different shape than the container 212.

The membrane may be attached between the lid and container of the cartridge. For instance, as further shown in FIG. 2, an upper portion of the membrane 241 may extend radially outwardly toward the container side walls 217 and over the rim 219 of the container such that the upper portion of the membrane 241 is sandwiched between the lid 238 and the rim 219. In some embodiments the membrane may be self-sealing, thereby not having an open portion 214 and negating the need for the lid 238. The membrane 240 can be attached to the lid and/or container 238 in any suitable way, such as by an adhesive, thermal welding, ultrasonic welding, over-molding, chemical bonding, crimping or other mechanical bonding, etc. As can be seen in FIG. 2, the upper portion of the membrane 241 that may be attached to the lid 238 can have an annular, or washer-like shape that extends radially outwardly toward the container side walls 217, but such radial extension is not required. In some embodiments the lid 238 may extend radially inward. In some embodiments the membrane 240 may be attached directly to the lid 238. As such, the membrane 240 may be suspended from the lid 238 and the first chamber may be positioned between the membrane 240 and the lid 238.

The membrane 240 is arranged to separate the first chamber 201 from the second chamber 202. Additional chambers in the interior space and/or sub-portions or areas of the first and second chambers, may be included in the cartridge 200. For example, it is possible for the cartridge to have three chambers that are separated by two membranes (e.g., a first membrane separates the first and second chambers and a second membrane separates two portions of the second chamber to create two sub-chambers), and so on, as described in greater detail herein. Similarly, the first and/or second chambers can be divided or otherwise separated into two or more portions or areas by filters, walls, dividers, passageways, and other features.

In the embodiment shown in FIG. 2, the container 212 may have a frustoconical cup shape formed by sidewalls 217, bottom 218, and an opening 213. Alternatively, the shape of the container 212 may be rectangular, spherical, semi-spherical, square, fluted, conical, cylindrical, etc. Additionally, the container 212 may have a fluted, corrugated, and/or otherwise shaped sidewalls 217. Further, the container 212 may not necessarily have a defined shape. For example, although the container 212 illustrated in FIG. 2 a relatively rigid and/or resilient construction so that the container 200 tends to maintain its shape, the container 212 may be made to have a more compliant and/or deformable arrangement, e.g., like a sachet container made from a sheet of deformable material. The size of the cartridge may be based on the size of the container. In this regard, the cartridge may be configured such that its interior space, as defined by the space within the container, may be any size.

The opening 213 can be closed by the lid 238, e.g., a foil and polymer laminate material that is attached to the rim 219 of the container 212. Though the rim 219 is arranged as an annular flange-like element in FIG. 2, in alternate embodiments the rim 219 can be arranged in other ways. For example, the rim 219 can be the top edge of the sidewall 217 without any flange element. In some embodiments the container 212 may be self-sealing, thereby not having an opening 213 and negating the need for the lid 238.

The container 212, membrane 240, and/or the lid 238 may provide a barrier to moisture and/or gases, such as oxygen. For example, like the membrane 240, the container 212, including the sidewalls 217 and bottom 218, may be made of one or more of a polymer laminate, e.g., formed from a sheet including a layer of polystyrene or polypropylene and a layer of EVOH and/or other barrier material, such as a metallic foil. In some embodiments the container may be comprised of one or more of polymers, biopolymers, compostable polymers, metals, ceramic, 3d-printable materials, nylon, polypropylene, paper, foils, etc. Such an arrangement can provide suitable protection for substances stored within the first and second chambers, 201 and 202. For example, the substances may be protected from unwanted exposure from moisture, oxygen and/or other materials. It should be understood, however, that the container 212, membrane 240, and/or the lid 238 may be made of other materials or combinations of materials, such as biopolymers, compostable polymers, paper, foils, etc.

In accordance with an aspect of the invention, a filter may be disposed within the cartridge. For example, as shown in FIG. 2, the filter 230 may be attached to the lid 238 by the lip 219 of the container 212. In this regard, the filter may be attached to the lid 238 in any suitable way, such as by an adhesive, thermal welding, ultrasonic welding, chemical bonding, crimping or other mechanical bonding, etc. As can further be seen in FIG. 2, the filter can have an annular, or washer-like shape that extends radially outwardly toward the container side walls 217, but such radial extension is not required. In some embodiments the filter 230 may extend radially inward away from the container side walls 217. In the embodiment of FIG. 2, the filter 230 may have a substantially frustoconical shape. However, the filter may have any suitable shape, such as a cylindrical shape, spherical shape, semi-spherical shape, a square cup shape, a domed shape, a flat shape, or other. Further, the filter 230 may have the same or different shape than the container 212.

Additionally, in some embodiments, the portion of the filter 230 attached to the lid 238 can extend radially outwardly toward the container side walls 217 and over the rim 219 such that part of the filter 240 is sandwiched between the lid 238 and the rim 219. In addition, the filter 230 may extend from the walls 217 of the container and at least partially into the interior space of the second chamber 202. Although the filter is shown within the second chamber 202, the filter may be positioned within the first chamber 201 or any other chamber. As a further alternative, the filter 230 can be freely placed in a chamber such that it is not attached to any portions of the cartridge 200. Further, no filters, or more than one filters may be present in a cartridge.

The filter 230 may function to prevent materials over a certain size from passing through to another chamber and/or out of the container. In this regard, the filter may include any suitable material, such as filter paper, permeable or impermeable plastic material, a sponge like material, foam, ceramic, zeolites, cellulose, natural and/or synthetic fabrics, etc. Also, the filter can include impermeable as well as permeable elements. For example, an impermeable plastic element may be attached to the lid and provide structural support for a filter paper or other material that is attached to the plastic element. The filter may have any suitable shape, size and/or permeability. For example, the filter may have areas of different permeability so as to prevent or restrict flow through some areas of the filter while facilitating flow through other, more permeable areas.

In some embodiments the filter may include a piece of filter paper that is arranged to allow a liquid and dissolved and/or suspended materials of a certain size to pass through, yet prevent relatively large particles from passing through. The filter 230 may have multiple stages (e.g., a coarse filter portion that filters out relatively large particles, followed by a fine filter portion that filters relatively smaller particles, etc.). In addition, the filter 230 may include one or more portions that function to filter substances passing through the filter 230, as well as portions that are impermeable or otherwise restrict flow. Thus, the filter 230 can include two or more separate components, if desired. For example, the filter 230 can include a rigid, fluid-impermeable plastic sleeve that is attached to the lid 238. At a location away from the lid 238, a porous filter paper can be attached to the sleeve. Thus, not all portions of the filter need be permeable to liquids.

The filter may also have areas with different permeability to assist in the direction of flow of the substances within the cartridge. For example, the filter region of the filter 230 near the lid 238 may have a relatively lower permeability as compared to regions of the filter closer to the bottom 218 of the cartridge. As such, when substances flow out of the cartridge, as described further herein, the substances may be directed to the bottom 218 of the cartridge 200.

One or more piercing mechanisms for piercing a membrane, sidewall, bottom, or other portion of a chamber or the container 212 may be maintained within the cartridge. For instance, as further illustrated in FIG. 2, a piercing mechanism 250 including a piercing shaft 252 and piercing tip 253 may be constructed within the first chamber 201.

The piercing mechanism may be positioned within the cartridge via one or more arms and one or more cuffs. In this regard the cuff 255 may provide anchoring support for attaching and positioning the piercing mechanism 250 to the cartridge 200. For example, a cuff 255 may be attached to the walls of the first chamber 201 in any suitable way, such as by an adhesive, thermal welding, ultrasonic welding, chemical bonding, crimping or other mechanical bonding, etc. While FIG. 2 shows only a single cuff and a single piercing mechanism positioned within the first chamber 201, there may be multiple cuffs and multiple piercing mechanisms within the first chamber 201 and/or any other chamber. In some embodiments, the piercing mechanism 250 may be attached directed to a membrane, wall, bottom, or other such portion of a cartridge without a cuff. Further, although the piercing mechanism 250 is shown as having the piercing tip 253 pointed in a downward direction relative to the lid 238, the direction of the piercing tip 253 may be in any direction.

One or more arms may attach the piercing mechanism 250 to the cuff 255. In this regard, the one or more arms may position and secure the piercing mechanism 250 at a certain location within a chamber or the cartridge. Further, the one or more arms may act as an actuator for the piercing mechanism 250, as described in greater detail herein. For example, as shown in FIG. 2, the one or more arms 254 may securely position the piercing mechanism 250 in a disengaged position (i.e., a position where the piercing tip is not puncturing or otherwise piercing any membranes, sidewalls, bottoms, etc.,) within the first chamber 201.

Figure 3:
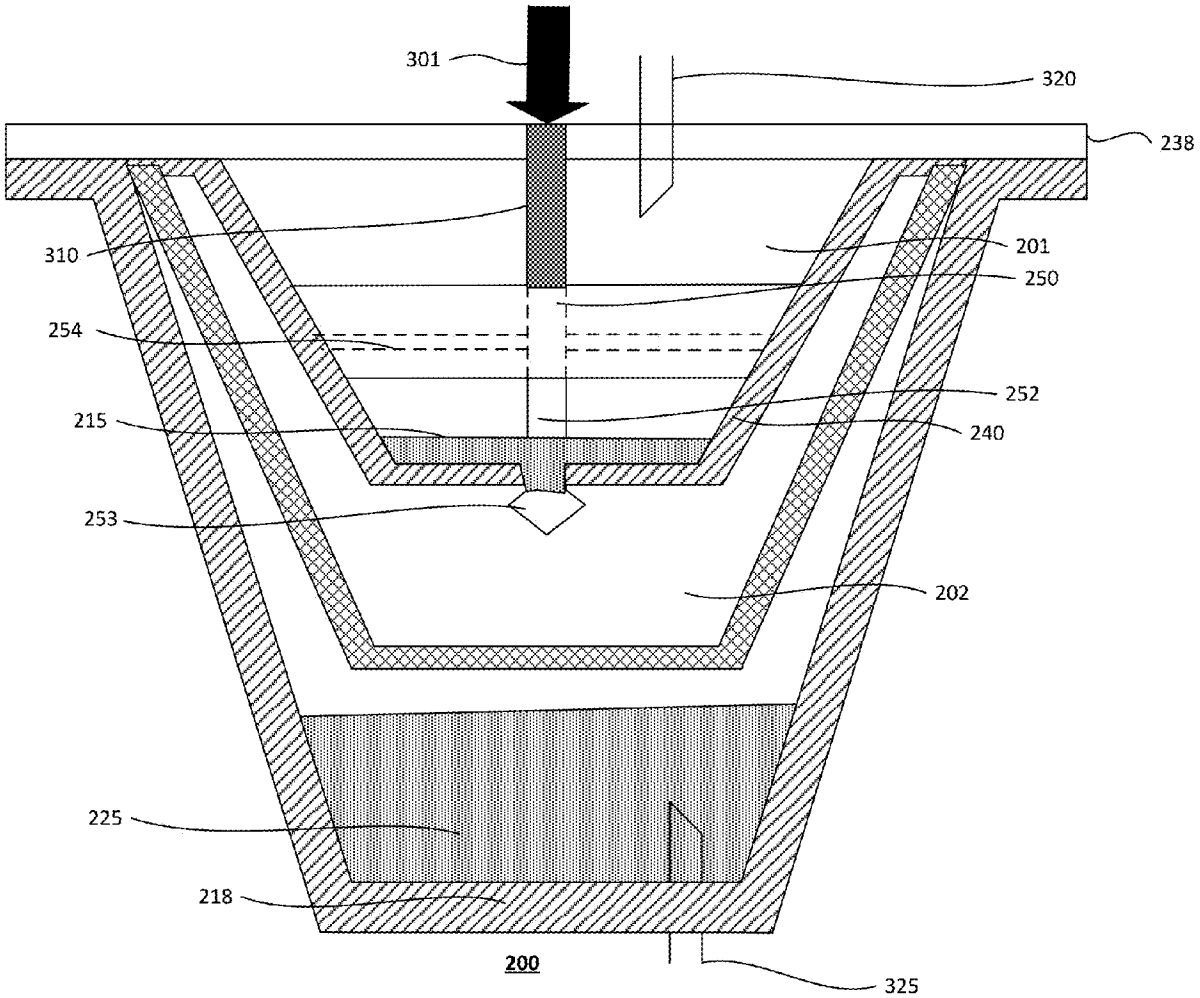
FIG. 3 is an illustration of the multi-chamber cartridge of FIG. 2 with a piercing mechanism in a piercing position in accordance with the present invention.

The piercing mechanism 250 may be activated from the disengaged position to a piercing position, thereby causing the substances within the chambers to mix together. In this regard, the cartridge 200 may be inserted into a dispensing machine. As illustrated in FIG. 3, forces, such as force 301, may be applied to the piercing mechanism 250 causing the piercing mechanism to switch from a disengaged position to an activated position. The force 301 may be applied on the piercing mechanism 250 by a machine shaft 310 of the dispensing machine. Although the force 301 being applied to the piercing element 250 is shown as being applied by a machine shaft 310, the force 301 may be generated by other sources such as a pressurized fluid. For instance, an externally located injection needle 320 may penetrate the lid 238 and introduce a pressurized fluid (e.g., gas, liquid, etc.,) into the first chamber 201. The pressurized fluid may cause the piercing mechanism 250 to activate into a piercing position. Further, a force may be applied by the dispensing machine to the bottom or walls of the container, and a counter force may be applied to the piercing mechanism 250 causing the piercing mechanism to switch from a disengaged position to an activated position.

Activation of the piercing mechanism into a piercing position may cause the piercing tip to pierce a surface of the cartridge (e.g., the container, membrane, lid or other such components of the cartridge such as a bottom wall, wall, membrane, etc.) For example, as shown in FIG. 3, as the force 301 applies pressure to the piercing mechanism 250, the piercing shaft 252 may be guided in the direction of the force 301 by the one or more arms 254. The piercing tip 253 may pierce the membrane 240 upon the piercing mechanism 250 being fully activated into the piercing position. In some embodiments upon the force 301 being removed from the piercing mechanism 250, the piercing mechanism may revert back to the disengaged position displayed such as shown in FIG. 2. Otherwise, the piercing mechanism 250 may remain in the piercing position as shown in FIG. 3.

Upon piercing the membrane the first substance 215 may evacuate the first chamber 201 into the second chamber 202. As such, the first substance 215 and the second substance 225 may mix together in the second chamber. In some embodiments, the second substance 225 may evacuate the second chamber 202 into the first chamber 201 and the substances may mix in the first chamber 201.

The mixed substances may be removed from the cartridge 200 by a second external needle 325. In this regard, the second external needle 325 may pierce the bottom 218 of the cartridge 200, to create a hole through which the mixed substances may drain out. In some embodiments the second external needle 325 may provide pressurized fluid into the cartridge 200 to force the mixed substance out of the cartridge 200. Although FIG. 3 shows the mixed material being removed via a hole created by the second external needle 325, the mixed materials may be removed through other channels. For example, the lid 238 may be removable and the mixed materials may be poured out of the top of the opening created by removing the lid 238.

Figure 4:
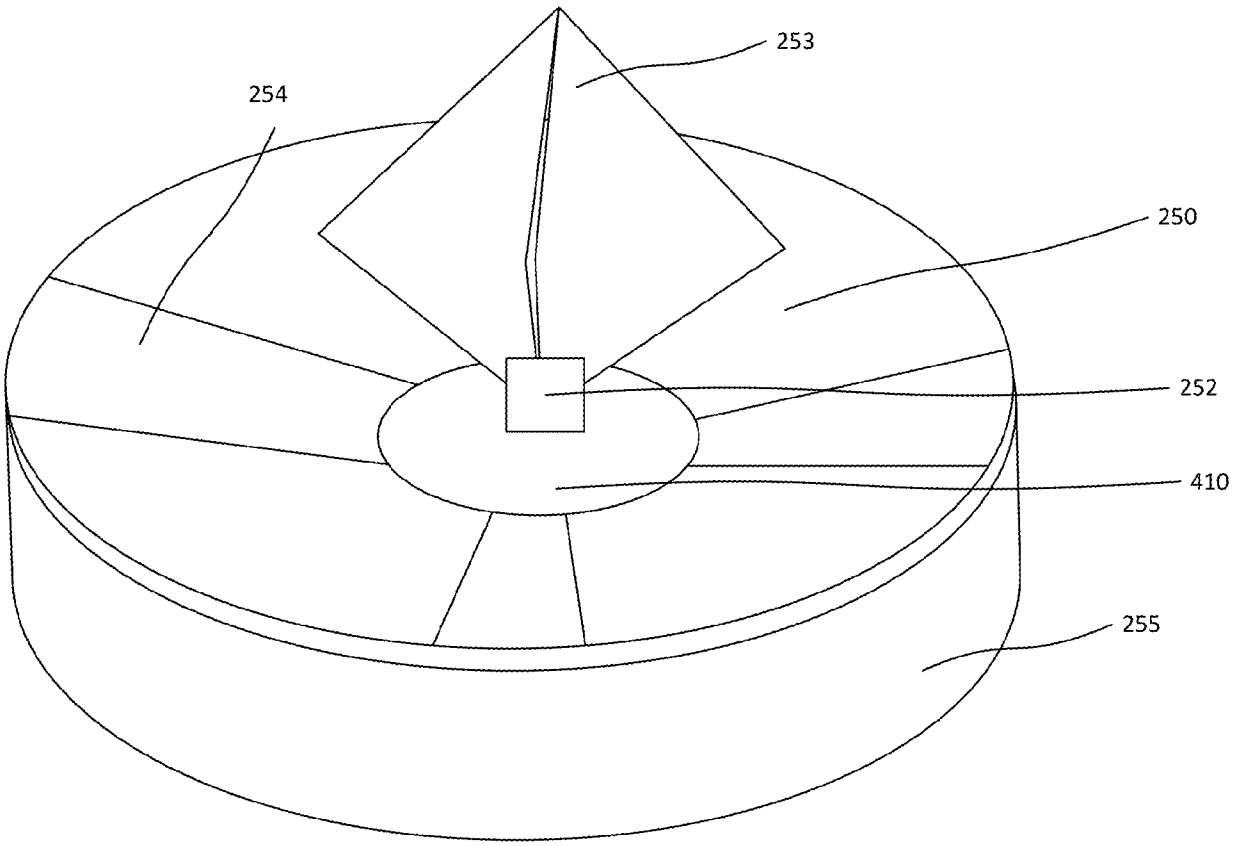
FIG. 4 is a perspective view of a piercing mechanism of the present invention.
Figure 5B:
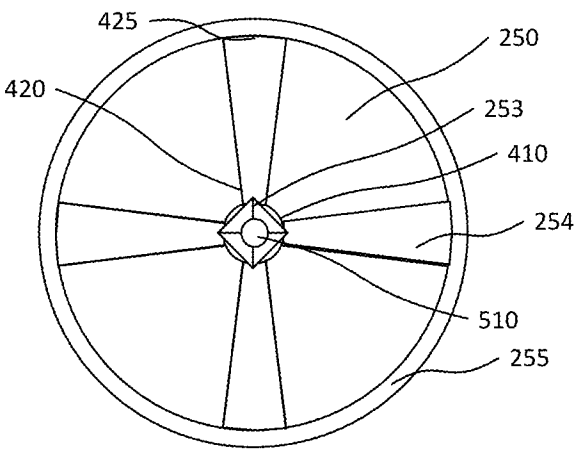
FIGS. 5A and 5B are top plan views of piercing mechanisms of the present invention.
Figure 5A:
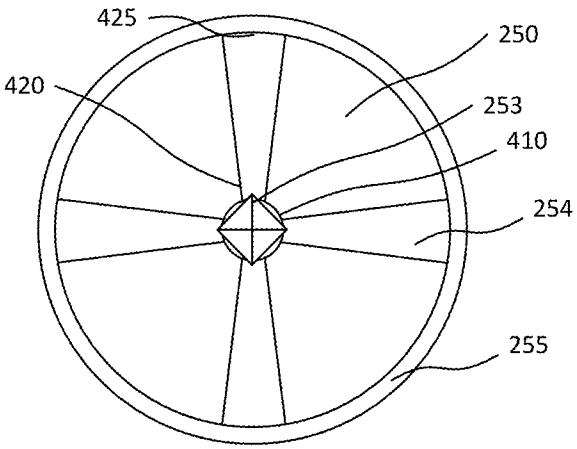

Turning now to FIGS. 4, 5A and 5B, perspective and top plan views of the piercing mechanism 250 with a cuff 255 and one or more arms 254 are shown. The piercing mechanism 250 may include a piercing shaft 252 and piercing tip 253 connected to the piercing shaft. The piercing mechanism 250 may be made of one or more materials, such as polymers, biopolymers, compostable polymers, metals, ceramic, 3d-printable materials, nylon, polypropylene, paper, foils, etc.

As shown in FIG. 5B, the piercing tip 253 may include a hollow path 510 to allow substances to pass through. For example, upon the piercing mechanism 250 piercing a chamber, the substance within the chamber may flow through the hollow path 510 into another chamber or out of the cartridge.

The piercing mechanism may further include one or more cuffs 255 and one or more arms 254. In this regard, the piercing shaft 252 may be attached to the cuff 255 via one or more arms 254. As illustrated in FIGS. 4, 5A, and 5B, the one or more arms 254 may each individually connect at a first end 425 to the cuff 255. The second end 420 of the one or more arms may be attached to the attachment plate 410 and the piercing shaft 252 may also be connected to the attachment plate 410. In some embodiments the piercing tip may be connected directly to the one or more arms and/or the attachment plate 410. The one or more arms may be constructed from one or more materials, such as polymers, biopolymers, compostable polymers, metals, ceramic, 3d-printable materials, nylon, polypropylene, paper, foils, etc. In some embodiments, the one or more arms may be comprised of an elastic or memory material thereby allowing the piercing mechanism to return to a disengaged position when force is removed. Although the piercing mechanism 250 is shown as attached to four arms, more or fewer arms may be attached. In some embodiments the piercing shaft 252 may be connected directly to the one or more arms 254 without an attachment plate.

Figure 6A:
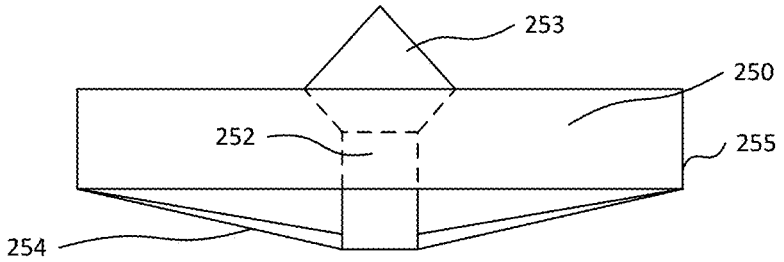
FIGS. 6A, 6B and 6C are side elevation views of a piercing mechanism of the present invention.
Figure 6B:
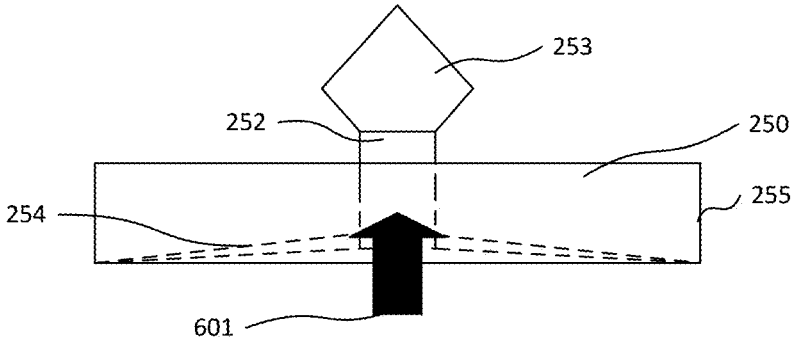

FIGS. 6A and 6B show the piercing mechanism in a disengaged and engaged position (i.e., activated piercing position), respectively. Turning first to FIG. 6A, when in the disengaged position, the one or more arms 254 of the piercing mechanism may position the piercing tip 253 partially within the cuff 255, although in some embodiments the piercing tip 253 may be fully positioned within or outside of the cuff 255. In this regard, the one or more arms 254 may control the position of the piercing shaft 252 which is connected to the piercing tip 253.

As illustrated in FIG. 6B, a force may be applied to the piercing mechanism 650, in a particular direction, such as direction 601. The force may cause the piercing mechanism to move into an engaged position. In this regard, the one or more arms 254 may bend and/or stretch to cause the piercing shaft 252 and piercing 253 to move into an engagement position. The one or more arms 254 may also prevent the piercing shaft 252 and piercing tip 253 from moving in an unintentional direction, by bending and/or stretching in a linear direction.

Figure 6C:
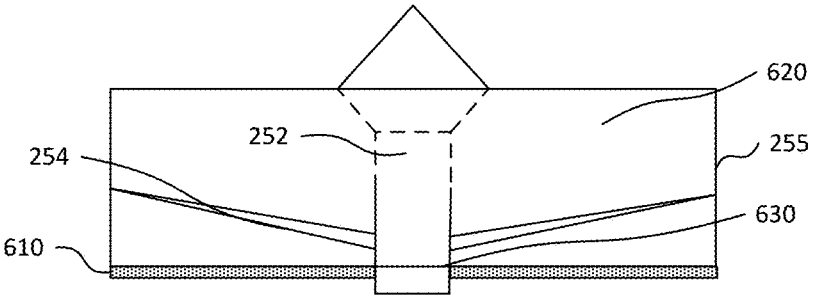

Turning to FIG. 6C, a side view of a piercing mechanism 620 including a filter 610 is shown. In this regard, the filter 610 may be attached to the top and/or bottom of the cuff 255 of the piercing mechanism 620 away from the operation of the one or more arms 254. In this regard, the filter 610 may include an opening 630 which may allow the shaft 252 of the piercing mechanism to move freely. As previously described, the filter 610 may have filters out particles larger than a predetermined size. In addition, the filter 230 may include one or more portions that function to filter substances of differing particle sizes from passing through the filter 230, as well as portions that are impermeable or otherwise restrict flow.

The piercing mechanism 250 may be bi-stable and include an over center springing action. As such, upon a force pushing the piercing mechanism beyond a certain distance while in the disengaged position, the piercing mechanism may switch to a piercing position. For example, as shown in FIG. 6B, when a force, such as force 601 causes the piercing shaft and tip 252 and 253 to move a certain distance, such as a quarter of an inch, or more or less, the piercing mechanism may switch into an engaged position, causing the piercing shaft and tip 252 and 253 to move another certain distance, such as a quarter of an inch, or more or less. The piercing mechanism 250 may be constructed such that it can fit cartridges of all sizes, and include the ability to move the piercing tip any number of distances. For instance, the piercing tip may be configured to move from 1 millimeter to 1 foot, or more or less.

Figure 7B:
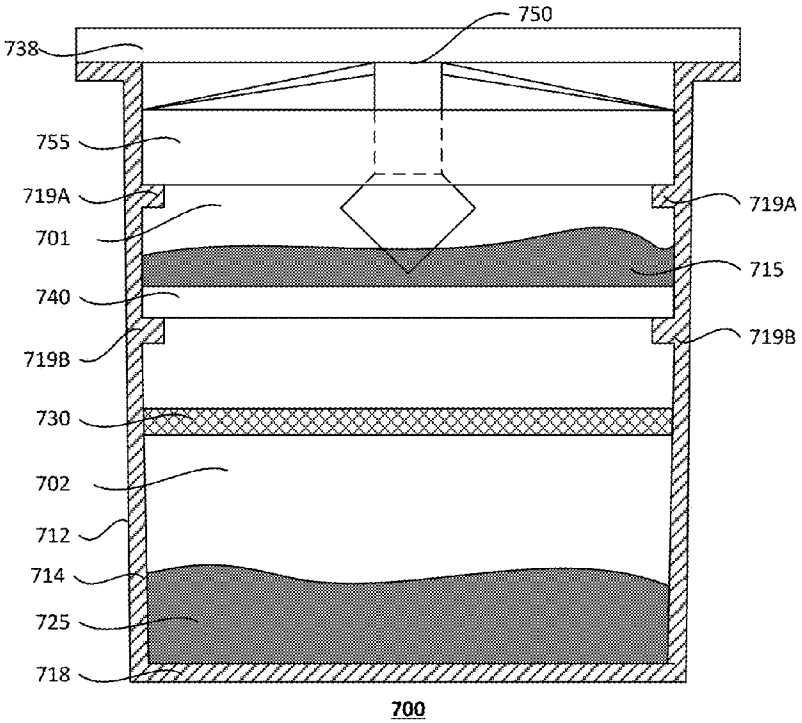
FIGS. 7A and 7B are cross sectional schematic views of a multi-chamber cartridge in accordance with aspects of the present invention.
Figure 7A:
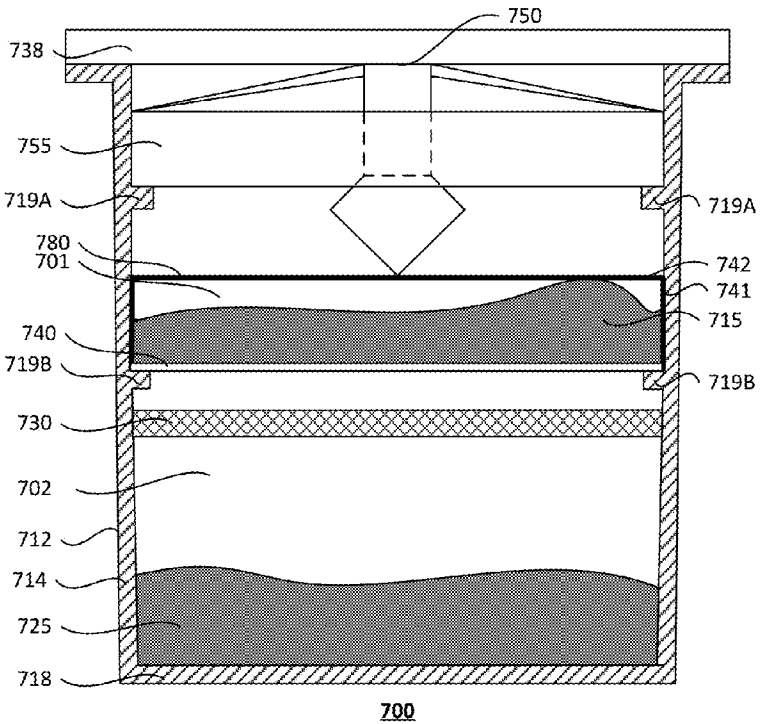

In some embodiments the cartridge may be constructed with supports to position one or more piercing mechanisms, modules, membranes and/or filters within the interior of the cartridge. For example, as shown in FIGS. 7A and 7B, a cartridge 700 may include a container 712 comprised of side walls 714 and a bottom 718. The sidewalls 714 may include supports such as supports 719A and 719B. The supports may be a continual ridge around the entire container's sidewalls and/or individual projections from the sidewalls. Although the supports are shown on the same horizontal plane in FIGS. 7A and 7B, the supports may be offset at different distances from the base 718 of the cartridge 700. In some embodiments a filter 730, as previously described, may be attached to one or more supports or attached directly to the side walls 714 of the cartridge 700. A lid 738 may enclose the cartridge 700, alternatively the cartridge may be self-sealing.

A membrane 740 may be attached or otherwise positioned on the supports to separate chambers. For instance, as further shown in FIG. 7B, the membrane 740 may extend across the interior of the container 712 and attach to the supports 719B. Although only two supports 719B are shown, the membrane may be attached to additional, or fewer supports. The membrane 740 may be the attached to the supports 719B in any suitable way, such as by an adhesive, thermal welding, ultrasonic welding, over-molding, chemical bonding, crimping or other mechanical bonding, etc.

The membrane 740 may be arranged to separate the first chamber 701 from the second chamber 702, as further shown in FIG. 7B. Additional chambers in the interior space and/or sub-portions or areas of the first and second chambers, may be included in the cartridge 700. For example, it is possible for the cartridge to have three chambers that are separated by two membranes (e.g., a first membrane separates the first and second chambers and a second membrane separates two portions of the second chamber to create two sub-chambers), and so on, as described in greater detail herein. Similarly, the first and/or second chambers can be divided or otherwise separated into two or more portions or areas by filters, walls, dividers, passageways, and other features. A first substance 715 may be positioned in the first chamber and a second substance 725 may be positioned in the second chamber 702.

In some embodiments the membrane may be part of a module 780. For instance, as shown in FIG. 7A, the membrane 740 may form the bottom portion of module 780. The module 780 may further include walls 741 and a top 742 and the interior of the module 780 may form the first chamber 701. The first substance 715 may be positioned within the first chamber 701 of module 780 and a second substance 725 may be positioned in the second chamber 702, as further illustrated in FIG. 7A. The membrane 740, sidewalls, and/or top 742 may be constructed from one or more fluid non-permeable material including polypropylene and cellulose material, a polymer laminate, e.g., formed from a sheet including a layer of aluminum, polystyrene and polypropylene and a layer of Ethylene Vinyl Alcohol copolymer "EVOH" and other such barrier materials. In addition the membrane 740, sidewalls, and/or top 742 may also be constructed from paper, bamboo, recycled materials, and other such films which may be flexible and/or rigid The module may be attached or otherwise positioned (i.e., rested) on the supports, such as supports 719B, as further shown in FIG. 7A. The membrane 740 may be the attached to the supports 719B in any suitable way, such as by an adhesive, thermal welding, ultrasonic welding, over-molding, chemical bonding, crimping or other mechanical bonding, etc. Multiple modules may be positioned within the cartridge 700.

The piercing mechanism may be attached or otherwise positioned on the supports. For example, as further shown in FIGS. 7A and 7B, the cuff 755 of piercing mechanism 750 may rest on supports 719A. In this regard, the piercing mechanism may be positioned in proximity to the membrane 740.

Figure 8B:
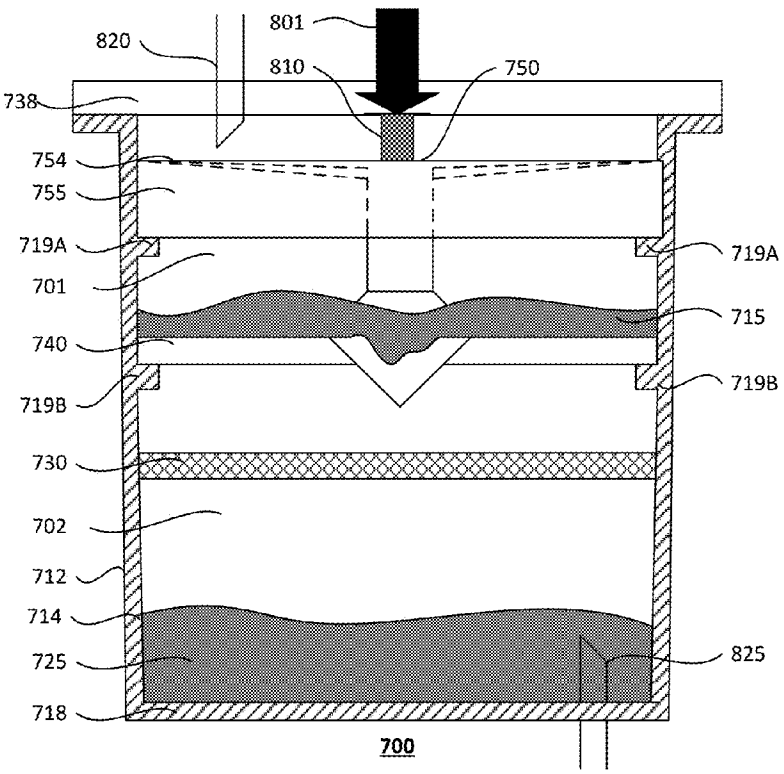
FIGS. 8A and 8B are cross sectional schematic views of a multi-chamber cartridge in accordance with additional aspects of the present invention.
Figure 8A:
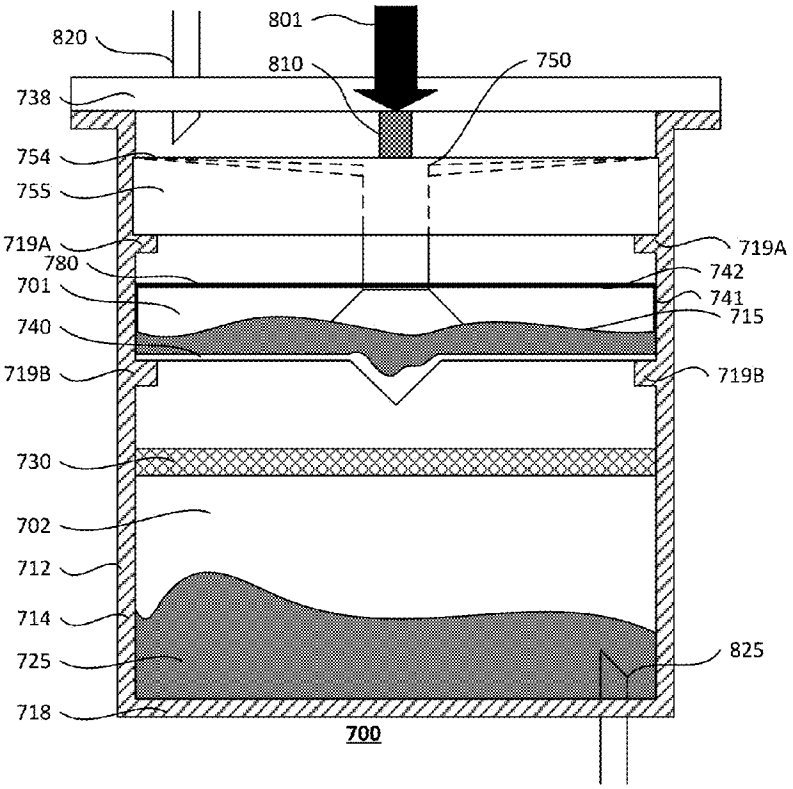

As previously described, the piercing mechanism may be activated from the disengaged position to a piercing position, thereby causing the substances within the chambers to mix together. In this regard, the cartridge 700 may be inserted into a dispensing machine. As shown in FIGS. 8A and 8B, forces, such as force 801, may be applied to the piercing mechanism 750 causing the piercing mechanism 750 to switch from a disengaged position to an activated position. In this regard, an opposite force may be generated from the supports 719A pushing against the cuff 755 causing the arms 754 to move the piercing mechanism into the activated position. The force 801 may be applied on the piercing mechanism 750 by a machine shaft 810 of the dispensing machine.

As shown in FIGS. 8A and 8B, upon the piercing mechanism 750 switching to the activated position, the piercing mechanism may pierce at least the membrane 740. Turning to FIG. 8A, the piercing mechanism 750 may pierce the top or sides of the module 780 prior to piercing the membrane 740.

Upon piercing the membrane the first substance 715 may evacuate the first chamber 701 into the second chamber 702 and, in some embodiments pass through filter 730. As such, the first substance 715 and the second substance 725 may mix together in the second chamber. In some embodiments, the second substance 725 may evacuate the second chamber 702 into the first chamber 701 and the substances may mix in the first chamber 701.

Although the force 801 being applied to the piercing element 750 is shown as being applied by a machine shaft 810, the force 801 may be generated by other sources such as a pressurized fluid. For instance, an externally located injection needle 820 may penetrate the lid 738 and introduce a pressurized fluid (e.g., gas, liquid, etc.,) into the first chamber 701. The pressurized fluid may cause the piercing mechanism 750 to activate into a piercing position. Further, a force may be applied by the dispensing machine to the bottom or walls of the container and a counter force may be applied to the piercing mechanism 750 causing the piercing mechanism to switch from a disengaged position to an activated position.

The mixed substances may be removed from the cartridge 700 by a second external needle 825. In this regard, the second external needle 825 may pierce the bottom 718 of the cartridge 700, to create a hole through which the mixed substances may drain out. In some embodiments the second external needle 825 may provide pressurized fluid into the cartridge 700 to force the mixed substance out of the cartridge 700. Although FIG. 8 shows the mixed material being removed via a hole created by the second external needle 825, the mixed materials may be removed through other channels. For example, the lid 738 may be removable and the mixed materials may be poured out of the top of the opening created by removing or puncturing at least a portion of the lid 738, and in some instances, the filter 730 and membranes, such as membrane 740.

Figure 9B:
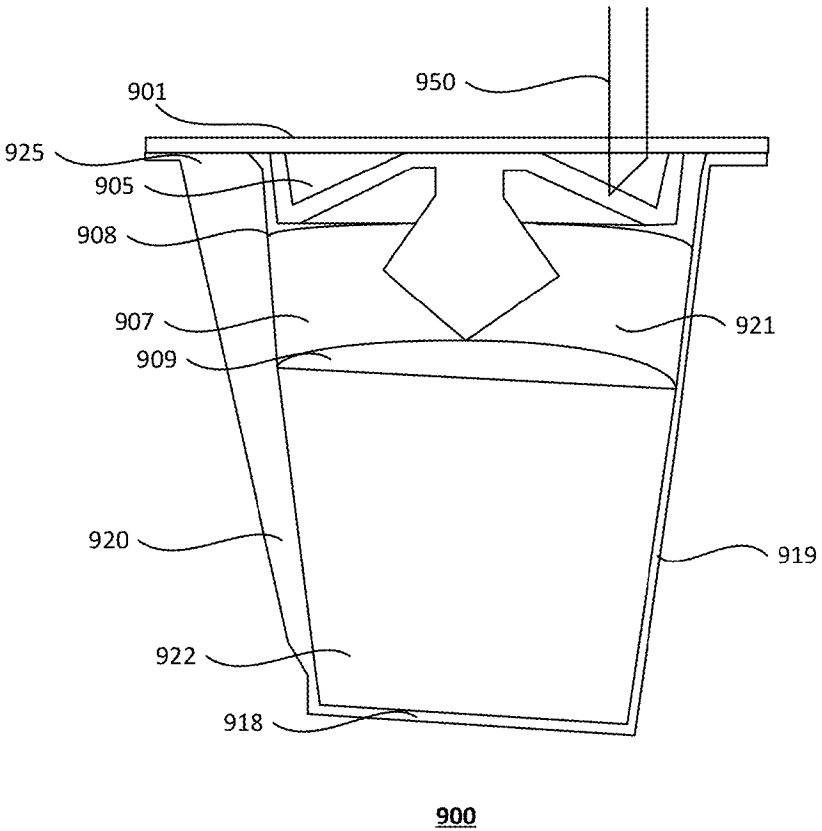
FIG. 9B is an assembled cross sectional schematic view of the cartridge shown in FIG. 9A.
Figure 9A:
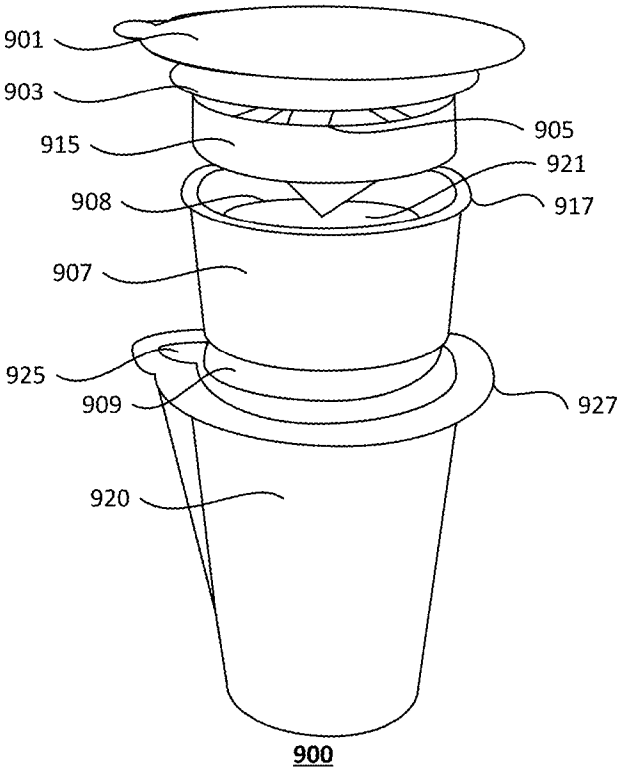
FIG. 9A is a perspective exploded view of a multi-chamber cartridge in accordance with another aspect of the present invention.

In some embodiments the cartridge may be configured as a carafe cup. For example, as shown in FIGS. 9A and 9B the cartridge 900 may be constructed of a carafe cup 920 comprising sidewalls 919 and a base 918, as well as a spout 925. A lid 901 may be used to seal the carafe cup 920.

A piercing mechanism may be positioned within a module. In this regard a module 907 may have a ledge 908 upon which a cuff 915 of the piercing mechanism 905 may rest. The bottom of the module 907 may be sealed by a lower seal 909 thereby forming a first chamber 921. A substance may be added to the first chamber, and be stored on top of the lower seal 909. As such, the piercing mechanism 905 may be positioned within the module 907 in proximity to the lower seal 909. The module 907 may be sealed by an optional sealing lid 903.

The module 907 may be inserted into the carafe cup 920. The lip 917 of the module 907 may be attached or rested upon the lip of the carafe cup 927. In some embodiments the sidewalls of the carafe cup 920 may include a ledge or supports, such as one or more projections extending inward toward the interior of the carafe cup. The lip of the module 907 may be positioned upon these supports. A seal 901 may be attached over the module 907 and attached to the lip of the carafe cup 927 and/or the lip of the module 917. A second substance may be positioned in the second chamber 922 formed by the base of the carafe cup 918 and the lower seal 909 of the module. Although only a single module 907 is shown, more than one module may be inserted into the cartridge 900.

As previously described, the piercing mechanism may be activated from the disengaged position to a piercing position, thereby causing the substances within the chambers to mix together. As shown in FIG. 9B, a piercing needle 950 may inject a fluid into the cartridge 900, thereby increasing pressure within the cartridge. As pressure builds up the fluid and mixed substances within the cartridge 900 may be forced out of the cartridge through spout 925. In some embodiments the cartridge may include one or more filters to prevent one or more substances from exiting through the spout 925. In some embodiments one or more additional piercing needles may be used to inject fluids or other substances, and/or assist in the drainage of the carafe cup.

Figure 10B:
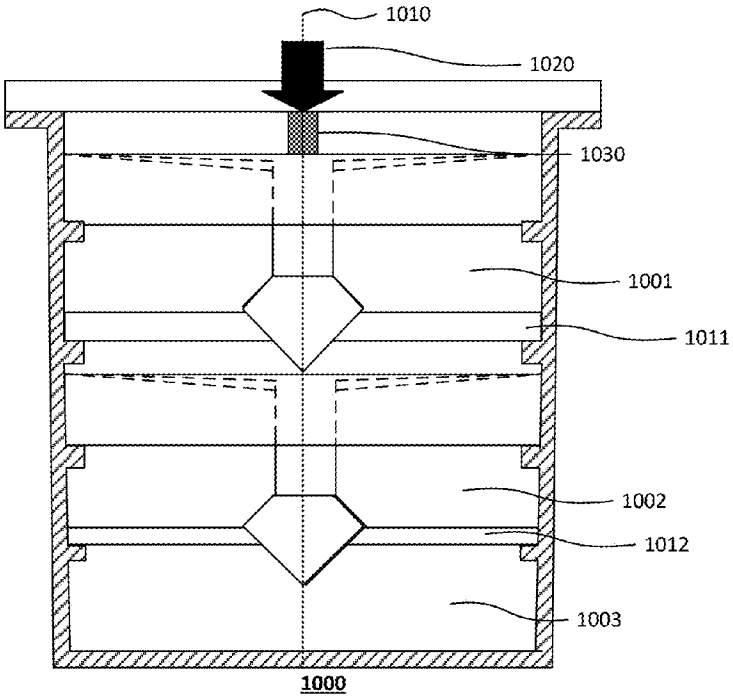
FIGS. 10A and 10B are cross sectional schematic views of another embodiment of a multi-chamber cartridge of the present invention.
Figure 10A:
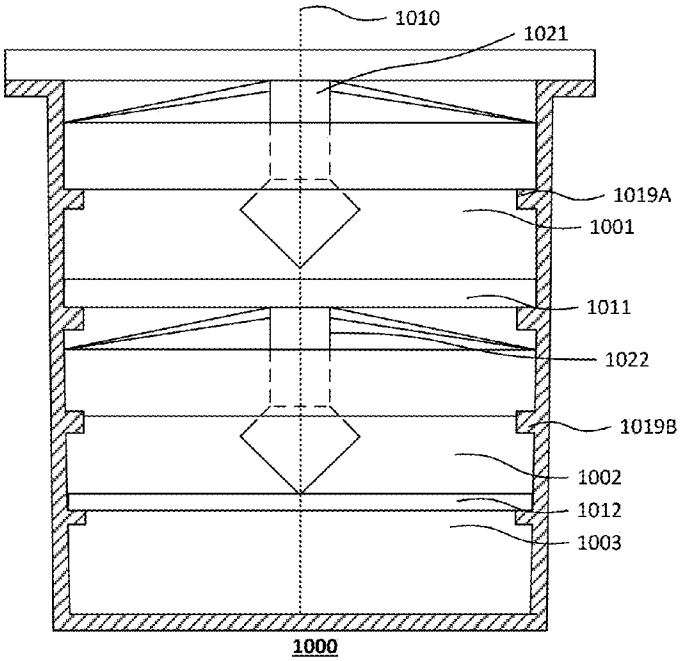

Piercing mechanisms may be stacked to pierce one or more chambers. For example, as shown in FIG. 10A, a multi-chamber cartridge 1000 may include three chambers 1001, 1002, and 1003. Piercing mechanisms may be placed within chambers 1001 and 1002 along the same axis 1010. In this regard, first piercing mechanism 1021 may be positioned upon supports 1019A in the first chamber 1001 in a disengaged positioned and second piercing mechanism 1022 may be positioned upon supports 1019B in the second chamber 1002 in a disengaged positioned. In some embodiments the multi-chamber cartridge 1000 may include one or more filters, such as filter positioned upon supports or attached directly to the walls of the cartridge.

Upon a force being applied to piercing mechanism of the first chamber one, both piercing elements 1021 and 1022 may be engaged. For example, as illustrated in FIG. 10B, upon a force 1020 being applied on the first piercing mechanism 1021 by a machine shaft 1030, the first piercing mechanism 1021 may activate. As such, the first piercing mechanism 1021 may pierce the first chamber's membrane 1011 and apply a force to the second piercing mechanism 1022. The force applied by the first piercing mechanism 1021 on the second piercing mechanism 1022 may cause the second piercing mechanism 1022 to pierce the second chamber's membrane 1012. Accordingly, the contents of the first chamber 1001 may be expelled into the second chamber 1002, and the contents of the first and second chamber may be expelled into the third chamber 1003. Although only three chambers and two piercing mechanisms are shown, the number of, and combinations of, chambers and piercing mechanisms is unlimited. Further, multiple piercing mechanisms may be stacked together in other cartridges such as a carafe cup.

The piercing mechanism may comprise multiple piercing elements capable of piercing one or more chambers. For example, as shown in FIG. 11A, a multi-chamber cartridge 1100 may include three chambers 1101, 1102, and 1103. The piercing mechanism 1190 may include a shaft 1110 which may be attached to piercing elements 1111 and a piercing tip 1113. Although a piercing tip and piercing elements are shown, only piercing elements 1111 may be attached directly to the shaft 1110.

The piercing shaft 1110 may be positioned within two or more chambers. For instance, as further shown in FIG. 11A, the shaft 1110 may be attached to one or more arms in the first chamber 1115 and one or more arms in the second chamber 1114. The one or more arms in the first chamber 1101 and the one or more arms in the second chamber 1114 may be attached to cuffs 1120 and 1121, respectively. In some embodiments only one cuff may be positioned in a single chamber, or alternatively, multiple cuffs may be positioned in a single chamber, or further, multiple cuffs may be positioned in multiple chambers.

The piercing shaft may be positioned in both chambers 1101 and 1102. In this regard, a gasket 1130, such as a rubber gasket may be positioned on the base of the first membrane 1140 to allow the shaft to pass through the first chamber 1101 into the second chamber 1102 without reducing the integrity of the membrane of the first chamber 1101. One or more arms 1114 and 1115 may hold the shaft 1110 in position by limiting the movement of the shaft 1110 to a single linear direction.

Figure 11B:
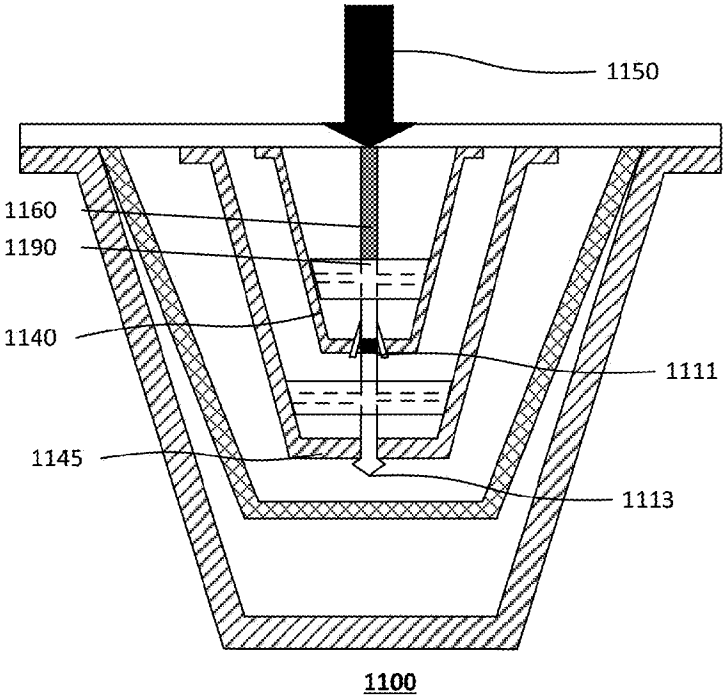
FIGS. 11A and 11B are cross sectional schematic views of another embodiment of a multi-chamber cartridge of the present invention.
Figure 11A:
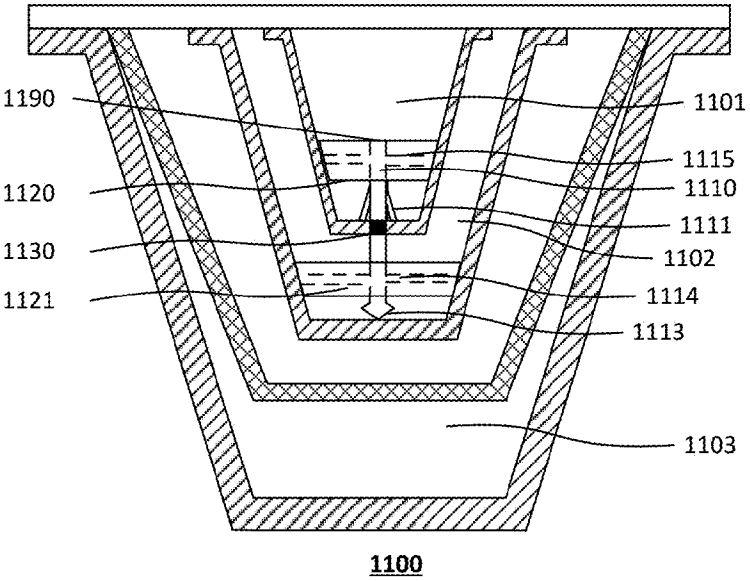

As illustrated in FIG. 11B, upon a force 1150 being applied on the piercing mechanism 1190 by a machine shaft 1160 (or pressure), the piercing mechanism 1190 may activate. As such, the piercing mechanism 1190 may pierce the first chamber's membrane 1140 and the second chamber's membrane 1145 simultaneously. In this regard, the force applied to the piercing mechanism 1190 may cause the piercing elements 1111 to pierce the first membrane 1140 and piercing tip 1113 to pierce the second membrane 1145. Accordingly, the contents of the first chamber 1101 may be expelled into the second chamber 1102, and the contents of the first and second chamber may be expelled into the third chamber 1103. The multiple piercing mechanism may be used in other cartridges than those shown in FIG. 11A, such as a carafe cup.

In some embodiments the substances within the chambers may not be mixed upon being pierced by the piercing mechanism. Rather, upon a chamber being pierced, the substances within the container may exit into another chamber or out of the cartridge.

The invention claimed is:

1. A multi-chamber cartridge comprising:

a plurality of chambers and a membrane arranged to separate a first and second one of the chambers, wherein the first chamber storing a first substance is positioned adjacent the second chamber; and a piercing mechanism mounted within the first chamber comprising a shaft and a piercing tip, wherein upon an external force being applied to the piercing mechanism, the piercing mechanism is adapted to pierce the membrane to allow the first substance to flow into the second chamber, wherein the piercing mechanism does not transport the first substance within the shaft.

2. The multi-chamber cartridge of claim 1 further comprising a filter, wherein the filter is positioned within the first chamber.

3. The multi-chamber cartridge of claim 1, wherein the second chamber stores a second substance.

4. The multi-chamber cartridge of claim 1 further comprising a container, wherein the container has a sidewall, a base, and an interior space, wherein the sidewall has a rim which projects outwardly from the sidewall and defines an opening of the container.

5. The multi-chamber cartridge of claim 4, wherein the sidewall has one or more inwardly extending projections.

6. The multi-chamber cartridge of claim 5, wherein the membrane is attached to a module, the module comprising a top and one or more side walls, wherein the module is positioned on one or more of the projections.

7. The multi-chamber cartridge of claim 6, wherein a seal is attached to the rim and is arranged to close the opening of the container.

8. The multi-chamber cartridge of claim 7, wherein the first chamber is a first portion of the interior space of the container enclosed within the module.

9. The multi-chamber cartridge of claim 6, wherein the second chamber is a second portion of the interior space of the container enclosed between the membrane and the base of the container.

10. The multi-chamber cartridge of claim 4, wherein the container is comprised of one or more of a polymer laminate, polymer, biopolymer, compostable polymer, metal, ceramic, nylon, polypropylene, paper, and foil.

11. The multi-chamber cartridge of claim 1, further comprising:

a third chamber and a second membrane arranged between the second and third chambers, wherein the third chamber stores a third substance.

12. The multi-chamber cartridge of claim 11, further comprising:

a second piercing mechanism mounted within the second chamber, wherein upon the piercing mechanism piercing the membrane, the piercing mechanism provides a second force upon the second piercing mechanism and upon the second force being applied to the second piercing mechanism the second piercing mechanism pierces the second membrane to allow the first and second substance to move to the third chamber and mix with the third substance.

13. The multi-chamber cartridge of claim 1, wherein the piercing mechanism is comprised of one or more of a polymer laminate, polymer, biopolymer, compostable polymer, metal, ceramic, nylon, polypropylene, paper, and foil.

14. The multi-chamber cartridge of claim 1, wherein the piercing mechanism further comprises a cuff and one or more arms, the shaft is attached to the cuff by the one or more arms, and the piercing top is attached to the shaft.

15. The multi-chamber cartridge of claim 14, wherein the cartridge comprises inwardly extending projections, and the cuff is mounted on at least one of the projections.

16. The multi-chamber cartridge of claim 1, wherein the piercing mechanism is bi-stable having an engaged and disengaged state.

17. A multi-chamber cartridge comprising:

a plurality of chambers and a first membrane arranged to separate a first and second one of the chambers, wherein the first chamber storing a first substance is positioned adjacent the second chamber storing a second substance; and a piercing mechanism mounted within the first chamber comprising a shaft and a piercing tip, wherein upon an external force being applied to the piercing mechanism, the piercing mechanism pierces the first membrane to allow the first substance to move to the second chamber and mix with the second substance, wherein the piercing mechanism does not transport the first substance within the shaft;

a third chamber and a second membrane arranged between the second and third chambers, the third chamber storing a third substance wherein the third chamber is positioned adjacent to the second chamber;

a second piercing mechanism mounted within the second chamber, wherein upon the piercing mechanism piercing the membrane, the piercing mechanism provides a second force upon the second piercing mechanism and upon the second force being applied to the second piercing mechanism the second piercing mechanism pierces the second membrane to allow the first and second substance to move to the third chamber and mix with the third substance.

18. The multi-chamber cartridge of claim 17, wherein the first piercing mechanism is attached to a first cuff by a first set of one or more arms and the second piercing mechanism is attached to a second cuff by a second set of one or more arms.

19. The multi-chamber cartridge of claim 18, wherein the first set of one or more arms and the second set of one or more arms are elastic.

* * * * *